US005273103A

United States Patent [19]

Tolve et al.

[11] Patent Number: 5,273,103

[45] Date of Patent: Dec. 28, 1993

[54] VERTICAL THIN-BODIES CONTINUOUS CASTING MACHINES

[75] Inventors: Pietro Tolve; Riccardo Tonelli, both of Rome; Emanuele Picco, Genova, all of Italy

[73] Assignee: Centro Sviluppo Materiali S.p.A., Rome, Italy

[21] Appl. No.: 868,211

[22] Filed: Apr. 14, 1992

[30] Foreign Application Priority Data

Apr. 17, 1991 [IT] Italy ..... 91A000265

[51] Int. Cl.[5] ..... B22D 11/00

[52] U.S. Cl. ..... 164/502; 164/504

[58] Field of Search ..... 164/428, 480, 466, 502, 164/468, 504

[56] References Cited

U.S. PATENT DOCUMENTS

| | | | |
|---|---|---|---|
| 3,746,074 | 7/1973 | Baumann | 164/502 |
| 4,020,890 | 5/1977 | Olsson | 164/466 |
| 4,936,374 | 6/1990 | Pareg | 164/428 |
| 4,974,661 | 12/1990 | Lari et al. | 164/503 |

FOREIGN PATENT DOCUMENTS

| | | | |
|---|---|---|---|
| 0489348A1 | 6/1992 | European Pat. Off. . | |
| 62-77154 | 4/1987 | Japan | 164/480 |
| 63-97341 | 4/1988 | Japan | 164/428 |
| 0162249 | 3/1989 | Japan | 164/428 |
| 0335851 | 2/1991 | Japan | 164/428 |
| 1530326 | 12/1989 | U.S.S.R. | 164/428 |
| 9118696 | 12/1991 | World Int. Prop. O. . | |

OTHER PUBLICATIONS

Patent Abstracts of Japan, vol. 16, No. 94 (M-1219) Mar. 9, 1992.

*Primary Examiner*—Richard K. Seidel
*Assistant Examiner*—James Miner
*Attorney, Agent, or Firm*—Oliff & Berridge

[57] ABSTRACT

In vertical thin-bodies continuous casting machines in which the liquid metal is cast in a mold formed by a pair of counter-rotating rolls with parallel longitudinal axes lying in the same horizontal plane and by a pair of containment plates facing onto the flat ends of the rolls, an electromagnetic device is introduced which produces a field of electromagnetic forces in a desired and given space formed between the plates and roll ends, the orientation and intensity of the forces being such as to impede leakage of liquid metal between the plates and the rolls. With this device the contact between plates and rolls is eliminated, as is the relative wear. Moreover, flat metal products are obtained that are substantially free from surface defects on the edges. Lastly, the absence of flashes on the edges due to metal infiltrating and solidifying between plates and rolls markedly decreases the possibility of jamming the machine.

12 Claims, 6 Drawing Sheets

VERTICAL THIN-BODIES CONTINUOUS CASTING MACHINES

BACKGROUND OF THE INVENTION

The present invention concerns an improvement for continuous thin-bodies casters. More precisely it concerns a system capable of maximizing plant productivity and product yield, by eliminating wear on plates and rolls caused by their mutual contact, thus reducing plant stoppages for removal of metal solidified between plates and rolls and minimizing the occurrence of shape defects on the edges of the casting such as flashes, profile variations, etc.

One of the technologies for the continuous casting of thin products provides for the casting of liquid metal, steel for instance, in a mold bounded by a pair of counter-rotating rolls with parallel axes lying in the same horizontal plane, and separated by a distance greater than the sum of the radii of the rolls and by two plates positioned at the flat ends of the rolls.

The plates consist essentially of refractory materials backed by a metal frame and in contact with the flat end faces of the rolls and the liquid metal. Thrust devices, springs for example, keep the plates hard against the roll contact surfaces to ensure the seal needed to contain the liquid metal.

This seal is subject to particularly difficult operating conditions because in addition to the thermal stress that is always present, there is continuous sliding contact between the plates and the flat ends of the rolls. This causes wear of the contact surfaces which allows the infiltration of steel.

The flashes that form the edges of the casting have a markedly adverse effect on surface quality in that part of the product and the yield of the heat and may even jam the rolls.

Regarding the abrasion problem, efforts have been made to optimize plate construction and also to increase the back-up pressure, while ensuring a flush fit with the rolls.

For instance, there have been proposals for composite plates having insulating materials in the central part to limit steel solidification, and wear-resistant seal materials in the zone in contact with the rolls. In this case, in addition to the problems of assembly and dimensional tolerances, there are big difficulties of the joints between insulating material and seal material, since these form a preferential point of anchorage for undesired fragments of solidified metal.

Monolithic plates made of abrasion-resistant refractories such as alumina or silica have also been proposed.

Where roll life is concerned, stellite facings have been used on the parts in contact with the plates and subject to abrasion due to reciprocal sliding.

However, none of these measures has completely resolved the difficulties described. Although attenuated, such difficulties as plate/roll seal, surface-quality of castings and roll jamming, still persist.

Attempts have also been made to utilize electromagnetic arrangements to resolve the problem of confinement of liquid metal, such as steel for instance, at the flat ends of the rolls; for example, in U.S. Pat. No. 4,936,374, the containment plates are replaced by a ac-fed electromagnetic device which produces a force in a direction such as to contain the steel. However, there are some drawbacks with this solution too. In fact, owing to the high density of the steel (about 7.2 kg/dm3) large, complex, high powered devices are needed to contain electromagnetically all the liquid metal present in the mold. There is also the possibility of stability problems with the induction generated field of force with ensuing loss of containment efficiency or at least lack of uniformity on the edges of the cast product. Hence such solutions appear to be economically and technically unacceptable.

Regarding the quality obtained, especially the problem of surface defects and shape near the corners of the cast products, attention must be focused on the importance of obtaining a product having a solidification profile that is as even and uniform as possible along the periphery of the cast section, so as to prevent the formation of weak points (cracks) and also avoid the need for costly operations downstream to remove the defects.

Attempts have been made in the past to eliminate these portions of defective products by grinding or trimming the edges of the strip or thin plate, for instance. However, such operations have proved unsatisfactory because of the cost and the space requirement of the equipment necessary and because of the volume of materials to be rejected or treated as scrap.

It is important to stress the difference which exists in the yield in the case of thin flat products on the one hand and thicker products on the other. In fact, since a certain quantity of material has to be eliminated, the percentage of waste on a thicker product is low, but where a thin product is concerned the proportion increases, of course, and can reach unacceptable levels.

Hence, notwithstanding the progress made so far in the continuous casting of thin products, the problems of confinement of a liquid metal in the mold, the surface quality of the casting at the edges and the jamming of the caster due to flashes of metal solidified between containment plates and rolls still remain unsolved.

SUMMARY OF THE INVENTION

The object of this invention is thus to propose a simple, reliable thin-slab continuous caster.

Another object is to eliminate the problem of reciprocal wear on rolls and plates.

Yet another object is greatly to reduce the occurrence of defects on the edges of the casting.

A further object is to minimize and possibly eliminate machine stoppages due to flashes on the edges of the casting solidifying between the rolls and the plates.

According to the present invention, an improvement is proposed for thin-bodies continuous casters in which a pair of counter-rotating rolls (whose longitudinal axes are parallel, lying in the same horizontal plane and separated by a distance that is greater than the sum of the radii of said rolls) each having a cylindrical external surface and two flat ends at right angles to the roll axis, and a pair of containment plates near the flat ends, bound a cavity in which liquid metal is cast, characterized by the fact that the plates are set away from the flat ends of the rolls, thus forming a space between them, and in the space an electromagnetic device produces a stationary field of electromagnetic forces directed towards the cavity, the field having at least one component lying in a plane parallel to the flat ends.

According to the present invention at least one magnet whose pole ends are directed towards the liquid metal is positioned at each side plate. The magnets have exciter windings.

Electrodes in contact with the cast metal are inserted in the lateral containment plates.

When in action, the exciter windings on the magnets have a direct-current feed to produce a stationary magnetic field, while the electrodes have a direct-current feed to produce a stationary electric field. The magnetic and electrical fields interact to produce the desired field of forces whose action, combined with the fact that there is no physical contact between the side plates and the rolls, permits elimination of wear between plates and rolls, and results in a product with defect-free edges.

As the molten metal tends to flow out from the zone in which it is cast, exerting an increasing thrust with depth, at least until solidification furnishes a self-containment effect, it is necessary to ensure distribution of current intensity or magnetic field that is variable with height. This distribution, with a minimum at the free surface of the bath, is assured by the particular arrangement of the electrodes or magnets.

BRIEF DESCRIPTION OF THE DRAWINGS

The present invention will now be described in greater detail by reference to the accompanying drawings which illustrate it purely by way of example, being in no way limiting as regards the object and breadth of the invention, namely.

DETAILED DESCRIPTION OF PREFERRED EMBODIMENTS

Figure 1:
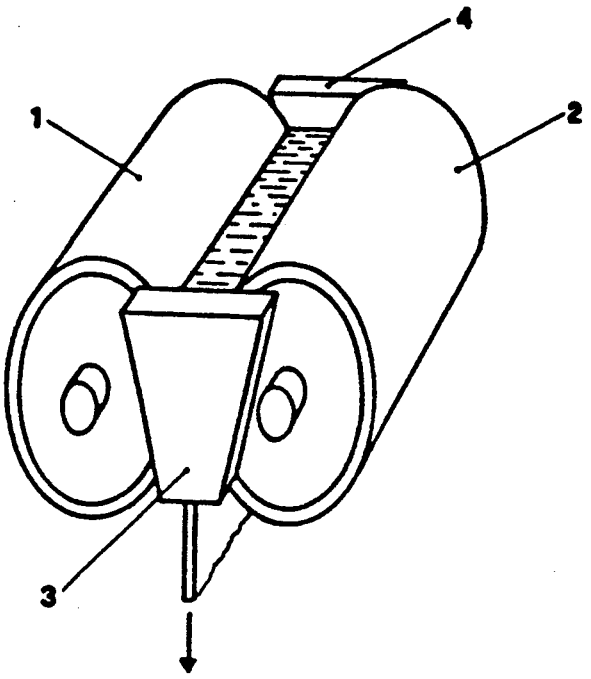
FIG. 1 which indicates the general layout of the invention.

With reference to FIG. 1, in a continuous caster the liquid metal is cast from above into a cavity formed by two counter-rotating rolls 1 and 2 and by two containment elements 3 and 4, symmetrically arranged with respect to the flat ends of the rolls 1 and 2.

Said containment elements 3 and 4 consist of refractory plates in contact with the liquid bath and at least one magnet (not shown in the Figure) whose pole ends are directed towards the liquid metal. Electrodes (not shown in the Figure) that are in contact with the molten bath are inserted in the containment plates, which are set at a distance of between 0.2 and 3 mm from the flat ends of the rolls. In operation, the magnetic field and the electric field are appropriately oriented so that in the space between said containment plates and rolls a field of force is obtained which is directed towards the cavity wherein the liquid metal is cast.

EXAMPLE 1

Figure 2:
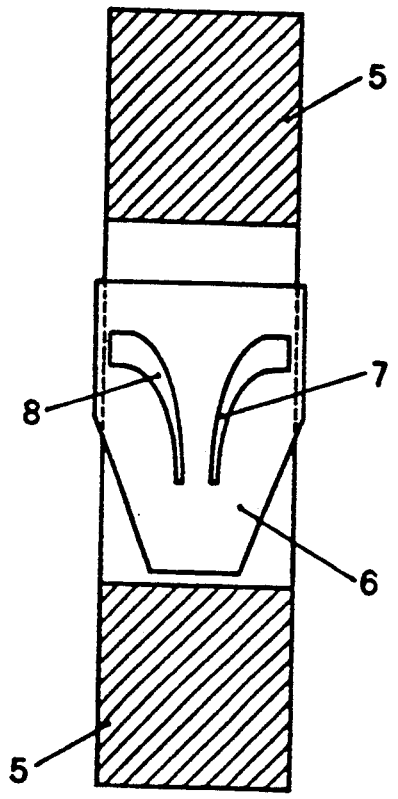
FIG. 2 which indicates a schematic side view of one embodiment.

With reference to FIG. 2 (view from within the cavity in which the liquid metal is cast), a C-shaped magnet 5, having a mainly vertical extension and pole ends directed towards the liquid metal, is positioned at each containment plate 6; said plates face towards the flat ends of the rolls 1 and 2, not shown in the drawing.

Said magnet 5 is arranged so that the free surface of the bath coincides preferably with the centerline of the magnetic-gap.

Elongated electrodes 7 and 8 in contact with the molten bath are inserted in the lateral containment plates in appropriate housings made of non-conducting material. The electrodes are arranged symmetrically about the vertical, barycentric axis of the plates and follow the profile of the rolls.

The distance between the electrodes decreases from the top downwards, thus ensuring the necessary current intensity which varies with height.

When direct-current is passed through the magnets 5 a magnetic field having a mainly vertical trend is produced near the plates 6. This field is directed upwards near one plate and downwards near the other, its intensity being for instance between 1000 and 5000 Gauss. Electrodes 7 and 8 have a direct-current feed and, as they are physically separated, electrical continuity between them is provided only via the liquid bath.

The feed is symmetrical and so the current flows in the bath in the same direction, for instance, from the left-hand roll 1 towards the right-hand one 2, current intensity being between 1000 and 10000 A. The magnetic field and the current components having a parallel trend on the axis of the rolls produce a field of force lying in a plane at right-angles to the axes of the rolls.

Figure 3:
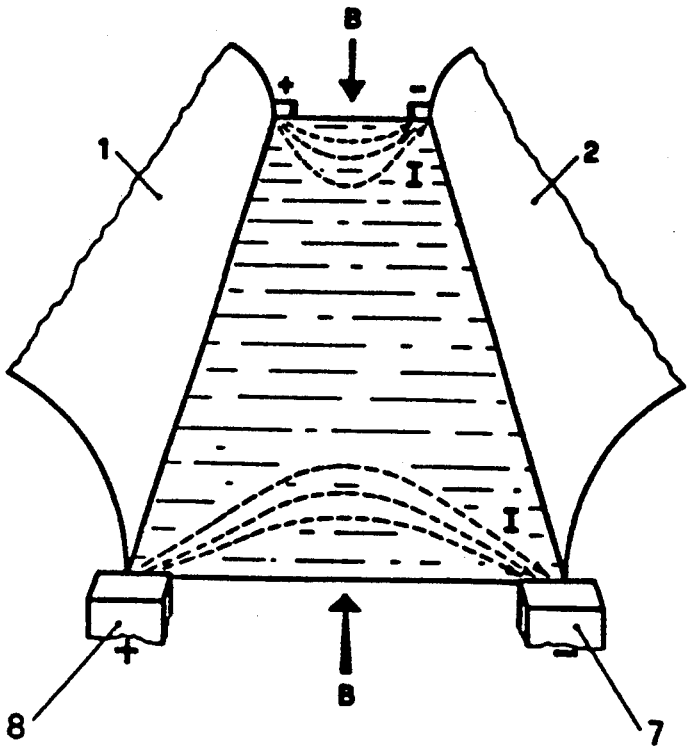
FIG. 3 which provides a first descriptive operating scheme of the proposed embodiment.

The operating scheme described is also illustrated in FIG. 3.

EXAMPLE 2

Electrodes arranged as in FIG. 2, produce antisymmetrical direct-current from one roll to the other, namely a current which, in the bath close to one plate, flows from the left-hand roll 1 towards the right-hand one 2 and vice versa close to the other plate.

The vertical magnetic field at each plate has the same direction and may be directed upwards or downwards, as the case may be.

Here, too, the resulting field of force lies in a plane at right-angles to the roll axes.

Figure 4:
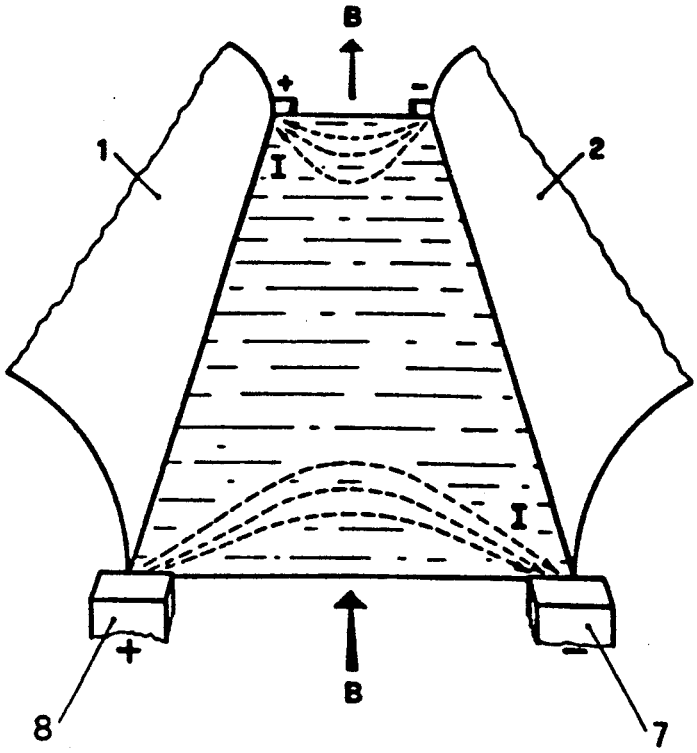
FIG. 4 which provides a second descriptive operating scheme of the proposed embodiment.

The operating scheme is also illustrated in FIG. 4.

Each individual electrode can also be replaced by complex systems formed by several electrodes interconnected in series or parallel so that current emission can be made to differ with height.

EXAMPLE 3

Figure 5:
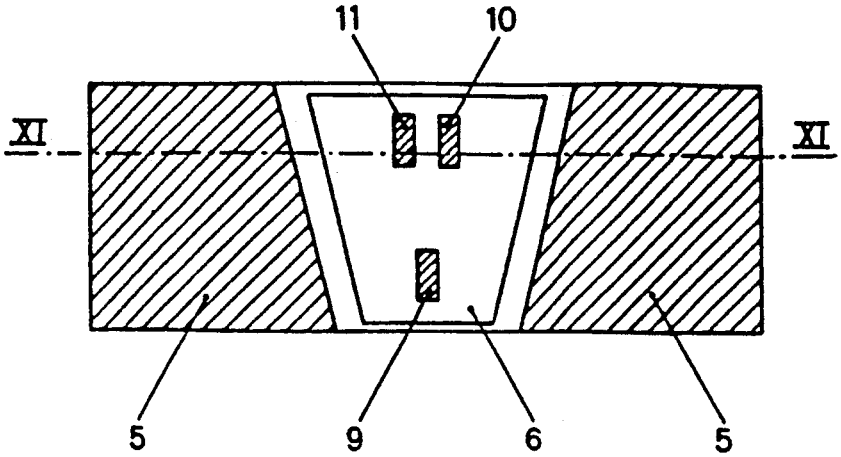
FIG. 5 which provides a schematic side view of another embodiment.

With reference to FIG. 5 (view of the interior of the cavity in which the metal is cast), the proposed invention provides for a magnet 5 which is longest in the horizontal direction and positioned at each containment plate 6.

The electrodes, which are electrically insulated from one another, are installed in the form of an inverted triangle in the containment plates where they are set in a matrix of refractory material. There is at least one electrode 9, 10, and 11 at each corner of the triangle. The polarity of the upper electrodes 11 and 10 is the same, while that in the lower position is opposite. All the electrodes are in contact with the molten bath.

Figure 6:
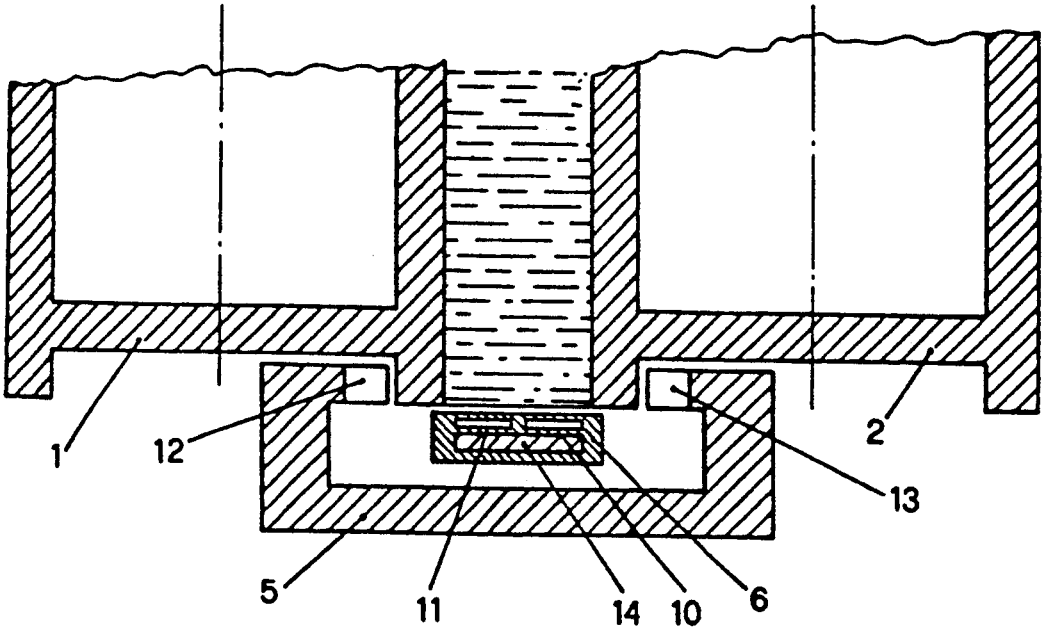
FIG. 6 which provides a bird's-eye view of a schematic section on XI—XI in FIG. 5.

With reference to FIG. 6, the ends of rolls 1 and 2 are set back from the edge of their shell, thus forming seats in which the pole ends of the magnet 12 and 13 are housed. The pole ends are made in such a way that their distance decreases continuously from top to bottom.

Furthermore, plates of ferromagnetic material 14, which can close the path of the magnetic field, thus reducing the magnetic-gap, are inserted in the lateral containment plates.

In operation, the lines of flux generated between the pole ends inserted in the seats between the ends of the rolls and the shell, are attracted through the plates of ferromagnetic material inserted in the side plates.

The magnetic field, closed between the pole ends 12 and 13 and the ferromagnetic plate 14 and the current, whose direction is essentially parallel to that of the outgoing solidified metal, produces a field of force located on the plate/roll interface profile and directed towards the liquid metal bath.

In this example, provision is made for a magnetic field running from the right-hand pole piece 13 to the left-hand one 12 and for a vertical current profile descending from the upper pair of electrodes 10 and 11 to the lower one.

With this configuration it is necessary to have fields of between 1000 and 5000 Gauss in the magnetic-gap and currents of between 100 and 1000 A in each upper electrode.

It is also possible to replace the upper pair of electrodes housed in the plates by a pair of electrodes having the same function but immersed in the bath near the plates, as close as possible to the surface of the rolls.

We claim:

1. A vertical thin-bodies casting machine comprising a pair of counter-rotating rolls having parallel longitudinal axes lying in the same horizontal plane and separated by a distance that is greater than the sum of the radii of said rolls, each of said rolls having a cylindrical external surface and two flat ends at right-angles to the roll axis, the casting machine further comprising a pair of containment plates near said flat ends, said rolls and plates forming a cavity in which liquid metal is cast, wherein said plates are set away from the flat ends of the rolls, thus forming a space between them, the machine including an electromagnetic device which in said space produces a stationary field of electromagnetic forces directed towards said cavity, said electromagnetic device comprising the combination of at least one electromagnet with direct-current feed and having pole-ends directed towards the cavity in which liquid metal is cast and at least two electrodes with direct-current feed facing towards said cavity in which the liquid metal is cast and set in said containment plates.

2. The machine according to claim 1, wherein said field of electromagnetic forces lies in a plane at right-angles to the axes of the rolls.

3. The machine according to claim 1, wherein said field of electromagnetic forces has at least one component lying in a vertical plane not at right-angles to the axes of the rolls.

4. The machine according to claim 1, wherein said electrodes are arranged symmetrically on the surface of each plate facing said cavity and are elongated in shape, said electrodes converging towards the bottom and in contact with said liquid metal.

5. The machine according to claim 1, wherein at least one vertically-elongated magnet is positioned at each of said plates.

6. The machine according to claim 5, wherein said magnet has a magnetic gap and a magnetic-gap centerline, said centerline being set near the free surface of the liquid metal cast in said cavity.

7. The machine according to claim 1, comprising at least one electrode positioned at each corner of a triangle, wherein the apex of the triangle faces downwards.

8. The machine according to claim 7, wherein the electrodes arranged at the upper corners of the triangle have the same polarity, and the electrode at the apex of the triangle has a polarity opposite to the polarity of the electrodes arranged at the upper corners of the triangle.

9. The machine according to claim 1, wherein at least one horizontally-elongated magnet having two pole-ends is positioned to surround each of said plates, said pole-ends being housed in seats defined by edges extending beyond the flat ends of said rolls.

10. The machine according to claim 9, having at least one magnet at each plate, the distance between the pole-ends of said magnet decreasing from the top downwards.

11. The machine according to claim 1, wherein said containment plates include plates of ferromagnetic material.

12. The machine according to claim 1, wherein said containment plates are set between 0.2 and 3 mm from the flat ends of the rolls.

* * * * *